US006025759A

United States Patent [19]

Takahashi

[11] Patent Number: 6,025,759

[45] Date of Patent: Feb. 15, 2000

[54] MICROWAVE INTEGRATED CIRCUIT INCLUDING SURFACE MOUNTING TYPE ISOLATOR

[75] Inventor: Kuniharu Takahashi, Tokyo, Japan

[73] Assignee: NEC Corporation, Tokyo, Japan

[21] Appl. No.: 09/104,353

[22] Filed: Jun. 25, 1998

[30] Foreign Application Priority Data

Jun. 26, 1997 [JP] Japan ..... 9-170332

[51] Int. Cl.[7] ..... H01P 1/387; H01P 1/36

[52] U.S. Cl. ..... 333/1.1; 333/24.2

[58] Field of Search ..... 333/1.1, 24.1, 333/24.2; 252/62.62, 62.63

[56] References Cited

U.S. PATENT DOCUMENTS

| | | | |
|---|---|---|---|
| 3,456,213 | 7/1969 | Hershenov | 333/1.1 |
| 3,770,639 | 11/1973 | Okazaki et al. | 252/62.63 X |
| 4,259,684 | 3/1981 | Dean et al. | 333/1.1 X |
| 5,776,275 | 7/1998 | Krishnamurthy et al. | 333/1.1 X |

FOREIGN PATENT DOCUMENTS

| | | |
|---|---|---|
| 60-25207 | 2/1985 | Japan . |
| 61-288486 | 12/1986 | Japan . |
| 1-238302 | 9/1989 | Japan . |
| 2-51406 | 4/1990 | Japan . |
| 7-14704 | 3/1995 | Japan . |
| 7-39103 | 7/1995 | Japan . |

OTHER PUBLICATIONS

Tadashi Hashimoto, Sohgohdenshi Shuppan, "Microwave Ferrite and Application Technologies", pp. 36–37,May 10, 1997.

Yoshihiko Akaiwa and Takeo Okazaki, "An Application of a Hexagonal Ferrite to a Millimeter–Wave Y Circulator", IEEE Transactions of Magnetics, vol. Mag–10, No. 2, Jun. 1974.

Lax et al., *Microwave Ferrites and Ferrimagnetics*, McGraw–Hill, N.Y., title page & p. 10, 1962.

*Primary Examiner*—Paul Gensler

*Attorney, Agent, or Firm*—McGinn & Gibb, P.C.

[57] ABSTRACT

Disclosed is a surface mounting type isolator, which comprises: ferrite 1 having an internal magnetic field so as to render an external magnetic field unnecessary; ceramic substrate 5 into which ferrite 1 is inserted; full-surface grounding conductor 7 disposed on one surface of ceramic substrate 5; branch lines 2, 3 disposed on the other surface of ceramic substrate 5, branch lines 2,3 being connected to two input/output terminals 11, 12; connecting portion 4 disposed on ferrite 1 and connected to branch lines 2, 3; and terminating resistor 6 connected to connecting portion 4.

42 Claims, 3 Drawing Sheets

MICROWAVE INTEGRATED CIRCUIT INCLUDING SURFACE MOUNTING TYPE ISOLATOR

BACKGROUND OF THE INVENTION

1. Field of the Invention

The present invention relates to an isolator and a circulator used in microwave band and millimeter wave band and in particular, to a surface mounting type isolator and a surface mounting type circulator. The present invention also relates to an MIC (Microwave Integrated Circuit) and an MCM (Multi-chip Module) in which a surface mounting type isolator or a surface mounting type circulator is included.

2. Description of the Prior Art

As a conventional microwave band isolator, an MIC isolator using MIC technology is well known.

For example, a prior art reference of such an MIC isolator is disclosed in Japanese Utility Model Laid-Open Publication No. 60-25207.

FIGS. 5A, 5B, and 5C are a plan view, a side view, and a bottom view of the MIC isolator of the prior art reference, respectively.

In FIGS. 5A, 5B, and 5C, reference numeral 51 is a permanent magnet. Reference numeral 52 is a ferrimagnetic substrate having a conductor pattern on one surface thereof. Reference numeral 53 is a non-magnetic grounding conductor plate that securely supports the other surface of ferrimagnetic substrate 52 and functions as a grounding conductor. Reference numeral 54 is a 50-ohm chip resistor. Reference numeral 55 is a junction area portion that is connected to branch lines 56. One terminal of 50-ohm chip resistor is connected to one of branch lines and the other terminal is connected to non-magnetic grounding conductor plate 53 by a conductor not shown in FIG. 5A, 5B, or 5C.

As another prior art reference, an isolator which uses an alumina-ceramic substrate in place of ferrimagnetic substrate and comprises a ferrite column inserted into the hole of the alumina-ceramic is disclosed in JPA-61-288486.

In a MIC, in order to keep the characteristics of semiconductor chips for use, the semiconductor chips are enclosed in an airtight package, whereby a radio frequency circuit using them is integrated. However, as explained above, the MIC isolator of the prior art requires a magnet. There are caused problems when the conventional MIC isolator is enclosed in a airtight package together with semiconductor chips because of the size of magnet and gases arose from an adhesive used for securing the magnet to the substrate. Therefore, it was difficult to enclose the conventional MIC isolator in the airtight package together with semiconductor chips.

Thus, a package which contains the conventional MIC isolator and another package which does not contain the conventional MIC isolator must be separately provided in order to form one radio frequency circuit. Hence, it was difficult to make the radio frequency circuit compact and light.

FIG. 6 is a schematic diagram showing an equivalent circuit of a frequency converter using the conventional MIC isolator. In FIG. 6, RF signal 60 is supplied to MIC isolator 50. The output signal of MIC isolator 50 is supplied to MIC amplifier 64 composed of an MIC semiconductor. MIC amplifier 64 amplifies the signal supplied from MIC isolator 50. The output signal of MIC amplifier 64 is supplied to MIC mixer 66. MIC mixer 66 is also supplied with local oscillation signal 61. MIC mixer 66 converts the frequency of the signal supplied from MIC amplifier 64 using local oscillation signal 61. MIC mixer 66 outputs the resultant signal as IF signal 62.

MIC isolator 50 is enclosed in MIC isolator package 63 while MIC amplifier 64 and MIC mixer 66 are enclosed in MIC package 65.

Thus, in addition to the problem that the mounting area increases, there is caused another problem that impedance characteristics in high-frequency deteriorates because the signal must be transmitted between packages 63 and 65 via a long path.

SUMMARY OF THE INVENTION

An object of the present invention is to provide a surface mounting type isolator and a surface mounting type circulator which can be enclosed in a airtight package together with semiconductor chips and which does not require a magnet.

Another object of the present invention is to provide an MIC and an MCM in which a surface mounting type isolator or a surface mounting type circulator is included together with a semiconductor chip.

According to one aspect of the present invention, there is provided a surface mounting type isolator, which comprises: a substance having an internal magnetic field so as to render an external magnetic field unnecessary, wherein the isolator is disposed on a surface of an MIC (Microwave Integrated Circuit) or an (Multi-chip Module) together with a semiconductor chip or semiconductor chips.

According to another aspect of the present invention, there is provided a surface mounting type isolator, which comprises: a substance having an internal magnetic field so as to render an external magnetic field unnecessary; a ceramic substrate into which the substance is inserted; a full-surface grounding conductor disposed on one surface of the ceramic substrate; branch lines disposed on the other surface of the ceramic substrate, the branch lines being connected to two input/output terminals; a connecting portion disposed on the substance and connected to the branch lines; and a terminating resistor connected to the connecting portion.

According to still another aspect of the present invention, there is provided an MIC which comprises: a header; a circulator mounted on the header and comprising a substance having an internal magnetic field so as to render an external magnetic field unnecessary, a ceramic substrate in which the substance is inserted, a full-surface grounding conductor disposed on one surface of the ceramic substrate, branch lines disposed on the other surface of the ceramic substrate, the branch lines being connected to two input/output terminals, and a connecting portion disposed on the substance and connected to the branch lines; a semiconductor chip mounted on the header; and a cap enclosing the circulator and the semiconductor chip.

According to a further aspect of the present invention, there is provided an MCM which comprises: a substrate; a circulator mounted on the substrate and comprising a substance having an internal magnetic field so as to render an external magnetic field unnecessary, a ceramic substrate in which the substance is inserted, a full-surface grounding conductor disposed on one surface of the ceramic substrate, branch lines disposed on the other surface of the ceramic substrate, the branch lines being connected to two input/output terminals, and a connecting portion disposed on the substance and connected to the branch lines; a semiconductor chip mounted on the substrate; and a cap enclosing the circulator and the semiconductor chip.

These and other objects, features and advantages of the present invention will become more apparent in light of the following detailed explanation of the preferred embodiments thereof, as illustrated in the accompanying drawings.

DESCRIPTION OF PREFERRED EMBODIMENTS

Next, with reference to FIGS. 1A and 1B, the basic structure of the surface mounting type isolator according to an embodiment of the present invention will be explained.

Figure 1A:
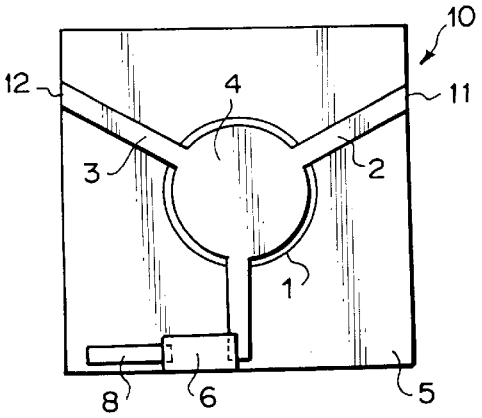
FIG. 1A is a plan view showing chip type isolator 10 according to an embodiment of the present invention.
Figure 1B:
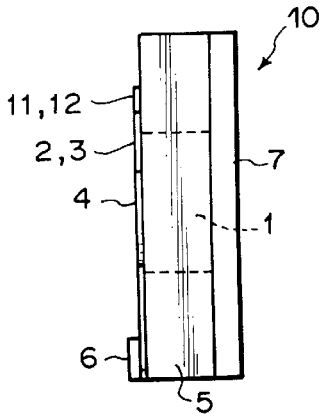
FIG. 1B is a side view of chip type isolator 10 according to the above embodiment the present invention.

FIGS. 1A and 1B are a plan view and a side view of surface mounting type isolator 10 according to the embodiment.

In FIGS. 1A and 1B, reference numeral 1 is a hexagonal crystal structure ferrite having an internal magnetic field. Reference numerals 2 and 3 are branch lines of an isolator. Reference numeral 4 is a junction area. Reference numeral 5 is a ceramic substrate. Reference numeral 6 is a 50-ohm terminating resistor. Reference numeral 7 is a full-surface grounding layer. Reference numerals 11 and 12 are input/output terminals.

Unlike the conventional structure, hexagonal crystal structure ferrite 1 has an internal magnetic field. Thus, an external magnet for causing the external magnetic field is not necessary.

There are many kinds of ferrite that have the aforementioned characteristics. Among them, a magnetoplumbite type ferrite is generally used.

The magnetoplumbite type ferrite is composed of magnetoplumbite which has a large anisotropic magnetic field.

The magnetoplumbite is a natural ore having a somewhat complicated hexagonal crystal structure. Since ferrite compounds expressed by a chemical formula of $MFe_{12}O_{19}$ have the same crystal structure as magnetoplumbite, they are referred to as magnetoplumbite type ferrites. Since magnetoplumbite ferrites of which M is Ba or Sr have a large anisotropic magnetic field, they have been widely used as permanent magnet materials.

It is known that a resonance type isolator of 100 GHz band can be obtained by using the magnetized Sr ferrite. This resonance type isolator need not include an external magnet.

Concerning details of the magnetoplumbite type ferrite, there is the literature titled "Microwave Ferrite and Application Technologies (translated title)", by Tadashi Hashimoto, Sohgohdenshi Shuppan, pp. 36–37, May 10, 1997.

According to the embodiment, an external magnet for generating an external magnetic field can be omitted by using the feature of a hexagonal crystal structure ferrite having an internal magnetic field. Thus, the isolator can be treated as a conventional surface mounting part. Therefore, the isolator can be disposed on a substrate as a chip in an MCM as well as an MIC.

Next, with reference to FIGS. 1A and 1B, a concrete structure of surface mounting type isolator 10 will be explained.

In FIGS. 1A and 1B, hexagonal crystal structure ferrite 1 is baked in a cylinder shape and inserted into ceramic substrate 5. Full-surface grounding conductor layer 7 is formed on one surface of ceramic substrate 5. A conductor pattern consisting of branch lines 2 and 3 extending from respective input/output terminals 11 and 12 of surface mounting type isolator 10, junction area 4 that is connected to branch lines 2 and 3, and rectangle area 8 is formed on the other surface of ceramic substrate 5. Reference numeral 6 is a 50-ohm terminating resistor which is formed of film or takes the form of a chip mounted by soldering. Rectangle area 8 is formed for filming or soldering of 50-ohm terminating resistor 6 and may not be grounded.

Figure 2:
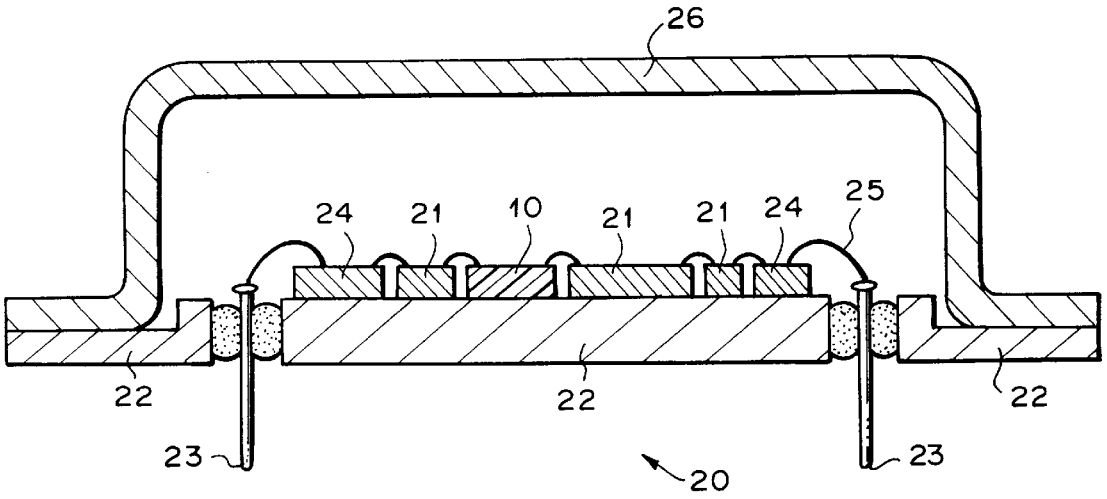
FIG. 2 is a sectional view showing an MIC according to another embodiment of the present invention having chip type isolator 10 shown in FIG. 1.

FIG. 2 is a sectional view showing an airtight MIC package 20 according to another embodiment of the present invention in which surface mounting type isolator 10 is enclosed together with semiconductor chips.

Surface mounting type isolator 10 in FIG. 2 is the same as surface mounting type isolator 10 which comprises a hexagonal crystal structure ferrite which is inserted into a ceramic substrate and renders a magnet unnecessary.

In addition to surface mounting type isolator 10, semiconductor chips 21 and connecting substrates 24 are mounted on MIC header 22 that is made of a metal. Surface mounting type isolator 10, semiconductor chips 21, and connecting substrates 21 are connected with MIC header 22 by solder, or the like.

Input/output terminals 11 and 12 of surface mounting type isolator 10 are connected with semiconductor chips 21 by bonding wires 25. Alternatively, gold ribbons may be used instead of the bonding wires 25.

The input/output signals of MIC 20 are interfaced with the outside through glass terminals 23. Glass terminals 23 are connected with connecting substrates 24 in MIC 20 by bonding wires 25.

Metal cap 26 of MIC 20 keeps airtightness of the whole of MIC 20 so as to prevent the surface of semiconductor chips 21 from deteriorating by ambient atmosphere.

Figure 3:
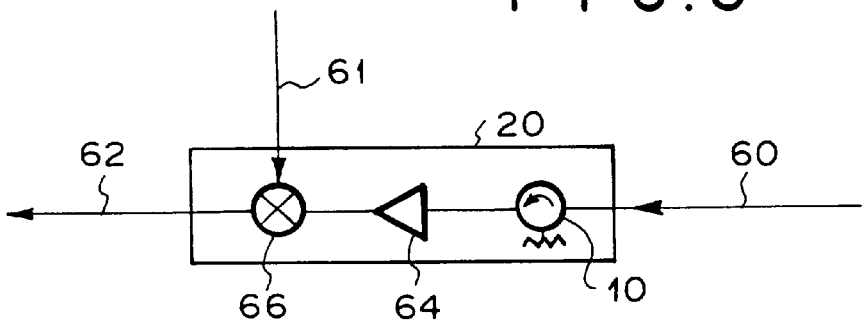
FIG. 3 is a schematic diagram showing an equivalent circuit of a frequency converter having chip type isolator 10 shown in FIG. 1.
Figure 6:
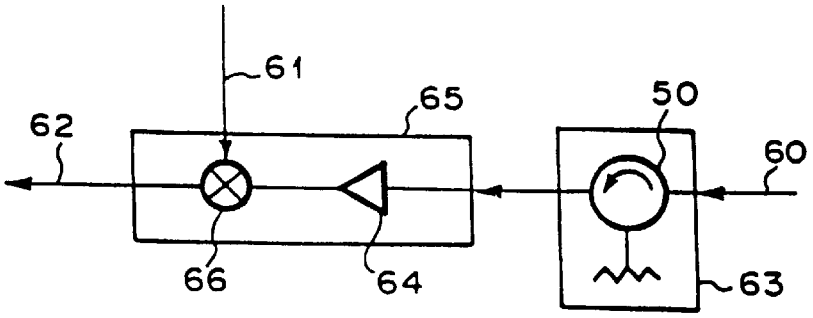
FIG. 6 (PRIOR ART)
FIG. 6 is a schematic diagram showing an equivalent circuit of a frequency converter having conventional MIC isolator 50.

FIG. 3 is a schematic diagram showing an equivalent circuit of MIC 20 shown in FIG. 2. Unlike the frequency converter using the conventional MIC isolator shown in FIG. 6, in case of the frequency converter shown in FIG. 3, surface mounting type isolator 10 is enclosed in the package of MIC 20 together with mixer 66 and amplifier 64 that are separate semiconductor chips.

Thus, surface mounting type isolator 10 can be directly connected with amplifier 64 by short bonding wires.

Therefore, high-frequency characteristics of the frequency converter does not deteriorate.

The hexagonal crystal structure ferrite used in surface mounting type isolator 10 has inner magnetic characteristics in an ultra high frequency band such as a millimeter wave band. Thus, the frequency of RF input signal 60 should be allocated in such frequency band.

Next, still another embodiment of the present invention will be explained.

Figure 4:
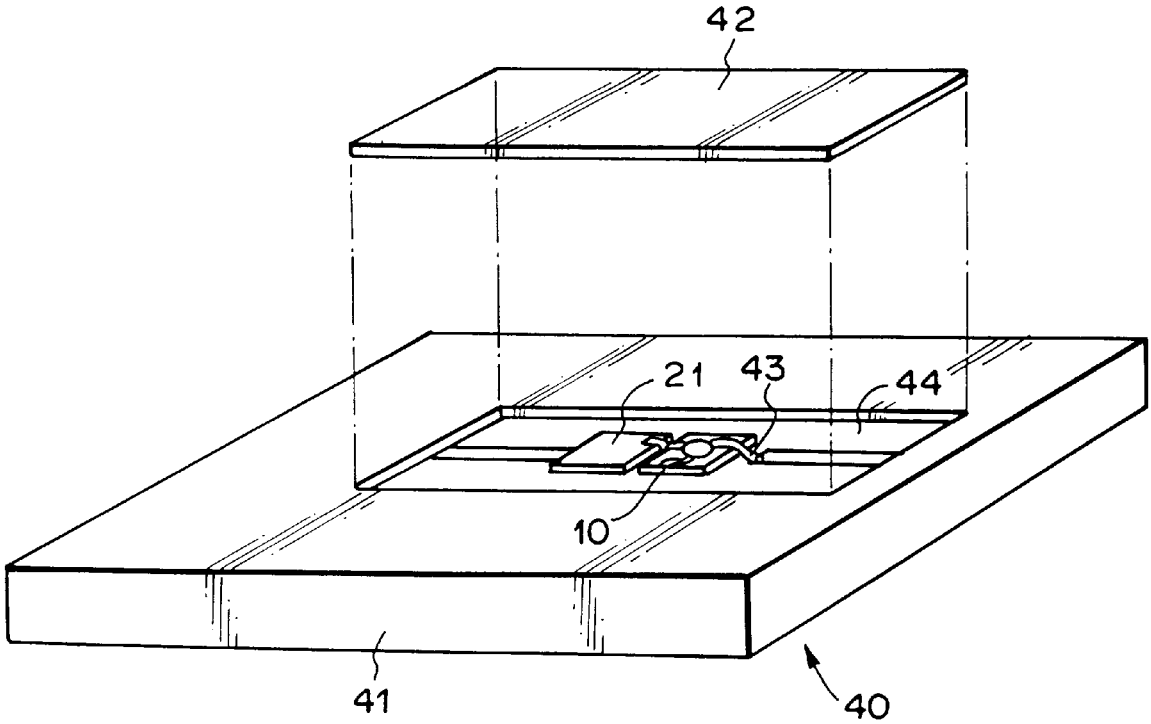
FIG. 4 is a perspective view showing MCM 40 according to still another embodiment of the present invention.
Figure 5A:
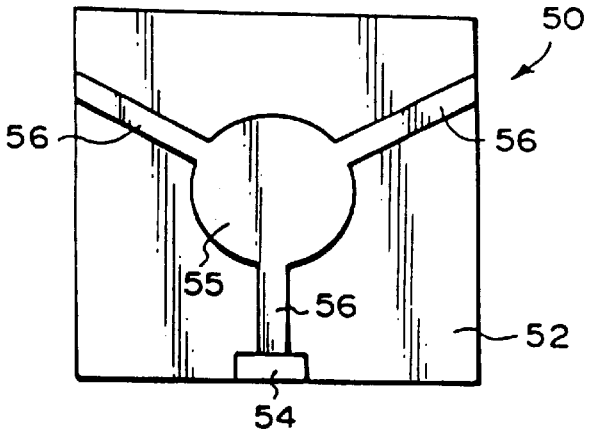
(PRIOR ART) FIG. 5A
FIG. 5A is a plan view showing conventional MIC isolator 50.
Figure 5B:
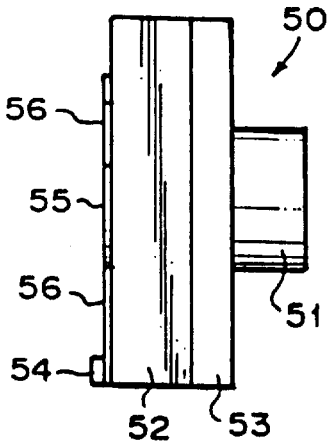
(PRIOR ART) FIG. 5B
FIG. 5B is a side view showing conventional MIC isolator 50.
Figure 5C:
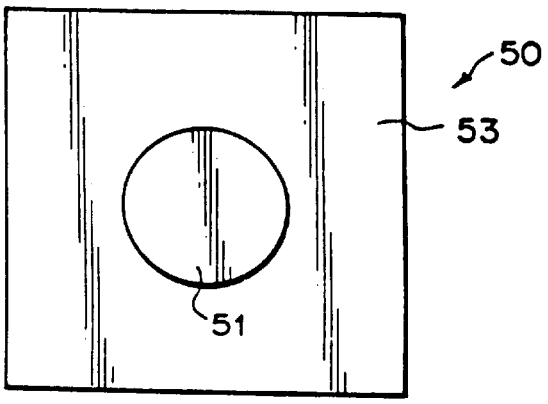
FIG. 5C (PRIOR ART)
FIG. 5C is a bottom view showing conventional MIC isolator 50.

FIG. 4 is a perspective view showing the structure of the MCM in which the surface mounting type isolator is enclosed.

In MCM 40, a part of an upper layer of MCM substrate 41 that is a dielectric laminate is cut out. Surface mounting type isolator 10 and semiconductor chip 21 are disposed in the cut-out portion of MCM substrate 41. Surface mounting type isolator 10 is connected with semiconductor chip 21 by ribbon 43 or bumps.

In order to maintain the airtightness of cut-out portion 44 in which semiconductor chip 21 and surface mounting type isolator 10 are disposed, MCM cap 42 is attached on cut-out portion 44.

In the aforementioned embodiments, isolators used for high frequency circuits were explained. However, it should be noted that the present invention can be applied to circulators used for high frequency circuits. If the terminating resistor 6 is omitted, the isolator becomes an circulator.

As explained above, since the surface mounting type isolator according to the present invention renders a magnet unnecessary, the same surface mounting type means can be commonly used for semiconductor chips and the surface mounting type isolator. Thus, the apparatus using them can be structured in high integration and in small size.

In addition, since the surface mounting type isolator according to the present invention and semiconductor chips can be unified in an MIC or an MCM, impedance matching in high frequency can be easily secured and high frequency characteristics can be improved.

Although the present invention has been shown and explained with respect to the preferred embodiments thereof, it should be understood by those skilled in the art that the foregoing and various other changes, omissions, and additions in the form and detail thereof may be made therein without departing from the spirit and scope of the present invention.

What is claimed is:

1. A structure comprising:

a surface mounting type isolator that comprises a substance having an internal magnetic field of such strength as to render the isolator devoid of an external magnetic field for its operation, and one of an MIC (Microwave Integrated Circuit) having a header and an MCM (Multi-chip Module) having a substrate with a semiconductor chip mounted thereon, wherein said surface mounting type isolator is disposed on one of said header of said MIC and said substrate of said MCM.

2. The structure as set forth in claim 1, wherein said substance is a ferrite.

3. The structure as set forth in claim 2, wherein said ferrite is a hexagonal crystal ferrite.

4. The structure as set forth in claim 3, wherein said hexagonal crystal ferrite is of magnetoplumbite type.

5. The structure as set forth in claim 1, wherein said surface mounting type isolator operates in one of a microwave band and a millimeter wave band.

6. A surface mounting type isolator comprising:

a substance having an internal magnetic field of such strength as to render the isolator devoid of an external magnetic field for its operation;

a ceramic substrate into which said substance is inserted;

a full-surface grounding conductor disposed on a surface of said ceramic substrate;

branch lines disposed on a second surface of said ceramic substrate, said branch lines being connected to two input/output terminals;

a connecting portion disposed on said substance connected to said branch lines; and a terminating resistor connected to said connecting portion.

7. The surface mounting type isolator as set forth in claim 6, wherein said surface mounting isolator is mounted on one of a header of an MIC and a substrate of an MCM.

8. The surface mounting type isolator as set forth in claim 6, wherein said substance is a ferrite.

9. The surface mounting type isolator as set forth in claim 8, wherein said ferrite is a hexagonal crystal ferrite.

10. The surface mounting type isolator as set forth in claim 9, wherein said hexagonal crystal ferrite is of magnetoplumbite type.

11. The surface mounting type isolator as set forth in claim 6, wherein said surface mounting type isolator operates in one of a microwave band and a millimeter wave band.

12. A structure comprising:

a surface mounting type circulator that comprises a substance having an internal magnetic field of such strength as to render the circulation devoid of an external magnetic field for its operation; and one of an MIC having a header and an MCM having a substrate with a semiconductor chip mounted thereon, wherein said surface mounting type circulator is disposed on one of said header of said MIC and said substrate of said MCM.

13. The structure as set forth in claim 12, wherein said substance is a ferrite.

14. The structure as set forth in claim 13, wherein said ferrite is a hexagonal crystal ferrite.

15. The structure as set forth in claim 14, wherein said hexagonal crystal ferrite is of magnetoplumbite type.

16. The structure as set forth in claim 12, wherein said surface mounting type circulator operates in one of a microwave band and a millimeter wave band.

17. A surface mounting type circulator comprising:

a substance having an internal magnetic field of such strength as to render the circulator devoid of an external magnetic field for its operation;

a ceramic substrate in which said substance inserted;

a full-surface grounding conductor disposed on a first surface of said ceramic substrate;

branch lines disposed on a second surface of said ceramic substrate, said branch lines being connected to two input/output terminals; and a connecting portion disposed on said substance and connected to said branch lines.

18. The surface mounting type circulator as set forth in claim 17, wherein said surface mounting circulator is mounted on one of a header of an MIC and a substrate of an MCM.

19. The surface mounting type circulator as set forth in claim 17, wherein said substance is a ferrite.

20. The surface mounting type circulator as set forth in claim 19, wherein said ferrite is a hexagonal crystal ferrite.

21. The surface mounting type circulator as set forth in claim 20, wherein said hexagonal crystal ferrite is of magnetoplumbite type.

22. The surface mounting type circulator as set forth in claim 17, wherein said surface mounting type circulator operates in one of a microwave band and a millimeter wave band.

23. An MIC (Microwave Integrated Circuit) comprising:

a header;

a surface mounting type circulator mounted on said header and comprising a substance having an internal magnetic field of such strength as to render the circulator devoid of an external magnetic field for its operation;

a semiconductor chip mounted on said header; and a cap enclosing said surface mounting type circulator and said semiconductor chip.

24. The MIC as set forth in claim 23, wherein said surface mounting type circulator further comprises:

a ceramic substrate in which said substance is inserted;

a full-surface grounding conductor disposed on a first surface of said ceramic substrate;

branch lines disposed on a second surface of said ceramic substrate, said branch lines being connected to two input/output terminals; and a connecting portion disposed on said substance and connected to said branch lines.

25. The MIC as set forth in claim 24, wherein said surface mounting type circulator further comprises a terminating resistor connected to said connecting portion.

26. The MIC as set forth in claim 23, wherein said substance is a ferrite.

27. The MIC as set forth in claim 26, wherein said ferrite is a hexagonal crystal ferrite.

28. The MIC as set forth in claim 27, wherein said hexagonal crystal ferrite is of magnetoplumbite type.

29. The MIC as set forth in claim 23, wherein said MIC operates in one of a microwave band and a millimeter wave band.

30. An MCM (Multi-chip Module) comprising:

a substrate, a surface mounting type circulator mounted on said substrate and comprising a substance having an internal magnetic field of such strength as to render the circulator devoid of an external magnetic field for its operation;

a semiconductor chip mounted on said substrate; and a cap enclosing said surface mounting type circulator and said semiconductor chip.

31. The MCM as set forth in claim 30, wherein said surface mounting tape circulator further comprises:

a ceramic substrate in which said substance is inserted;

a full-surface grounding conductor disposed on a first surface of said ceramic substrate;

branch lines disposed on a second surface of said ceramic substrate, said branch lines being connected to two input/output terminals; and a connecting portion disposed on said substance and connected to said branch lines.

32. The MCM as set forth in claim 31, wherein said surface mounting type circulator further comprises a terminating resistor connected to said connecting portion.

33. The MCM as set forth in claim 30, wherein said substance is a ferrite.

34. The MCM as set forth in claim 33, wherein said ferrite is a hexagonal crystal ferrite.

35. The MCM as set forth in claim 34, wherein said hexagonal crystal ferrite is of magnetoplumbite type.

36. The MCM as set forth in claim 30, wherein said MCM operates in one of a microwave band and a millimeter wave band.

37. A surface mounting type isolator comprising:

a magnetoplumbite type hexagonal crystal ferrite having an internal magnetic field of such strength as to render the isolator devoid of an external magnetic field for its operation;

a ceramic substrate into which said substrate is inserted;

a full-surface grounding conductor disposed on a first surface of said ceramic substrate;

branch lines disposed on a second surface of said ceramic substrate, said branch lines being connected to two input/output terminals;

a connecting portion disposed on said substrate and connected to said branch lines; and a terminating resistor connected to said connecting portion.

38. A surface mounting type circulator comprising:

a magnetoplumbite type hexagonal crystal ferrite having an internal magnetic field of such strength as to render the circulator devoid of an external magnetic field for its operation;

a ceramic substrate into which said substrate is inserted;

a full-surface grounding conductor disposed on a first surface of said ceramic substrate;

branch lines disposed on a second surface of said ceramic substrate, said branch lines being connected to two input/output terminals; and a connecting portion disposed on said substrate connected to said branch lines.

39. An MIC comprising:

a header;

a surface mounting type isolator directly mounted on said header;

a semiconductor chip directly mounted on said header; and a cap enclosing said surface mounting type isolator and said semiconductor chip, wherein said surface mounting type isolator comprises:

a magnetoplumbite type hexagonal crystal ferrite having an internal magnetic field of such strength as to render the isolator devoid of an external magnetic field for its operation;

a ceramic substrate into which said substrate is inserted;

a full-surface grounding conductor disposed on a first surface of said ceramic substrate;

branch lines disposed on a second surface of ceramic substrate, said branch lines being connected to two input/output terminals;

a connecting portion disposed on said substrate connected to said branch lines; and a terminating resistor connected to said connecting portion.

40. An MIC comprising:

a header;

a surface mounting type circulator directly mounted on said header;

a semiconductor chip directly mounted on said header; and a cap enclosing said surface mounting type circulator and said semiconductor chip, wherein said surface mounting type circulator comprises:

a magnetoplumbite type hexagonal crystal ferrite having an internal magnetic field of such strength as to render the circulator devoid of an external magnetic field for its operation;

a ceramic substrate into which said substrate inserted;

a full-surface grounding conductor disposed on a first surface of said ceramic substrate;

branch lines disposed on a second surface of ceramic substrate, said branch lines being connected to two input/output terminals; and a connecting portion disposed on said substrate connected to said branch lines.

41. An MCM comprising:

a substrate;

a surface mounting type isolator directly mounting on said substrate;

a semiconductor chip directly mounted on ceramic substrate; and a cap enclosing said surface mounting type isolator and said semiconductor chip, wherein said surface mounting type isolator comprises:

a magnetoplumbite type hexagonal crystal ferrite having an internal magnetic field of such strength as to render the isolator devoid of an external magnetic field for its operation;

a ceramic substrate into which said substrate is inserted;

a full-surface grounding conductor disposed on a first surface of said ceramic substrate;

branch lines disposed on a second surface of said ceramic substrate, said branch lines being connected to two input/output terminals;

a connecting portion disposed on said substrate and connected to said branch lines; and a terminating resistor connected to said connecting portion.

42. An MCM comprising:

a substrate;

a surface mounting type circulator directly mounted said header;

a semiconductor chip directly mounted on said header; and a cap enclosing said surface mounting type circulator and said semiconductor chip, wherein said surface mounting type circulator comprises:

a magnetoplumbite type hexagonal crystal ferrite having an internal magnetic field of such strength as to render the circulator devoid of an external magnetic field for its operation;

a ceramic substrate into which said substrate inserted;

a full surface grounding conductor disposed on a first surface of said ceramic substrate;

branch lines disposed on a second surface of said ceramic substrate, said branch lines being connected to two input/output terminals; and a connecting portion disposed on said substrate and connected to said branch lines.

* * * * *